US006660894B1

(12) United States Patent
Wu et al.

(10) Patent No.: US 6,660,894 B1
(45) Date of Patent: Dec. 9, 2003

(54) PROCESS FOR UPGRADING AN OLIGOMERIZATION PRODUCT

(75) Inventors: An-hsiang Wu, Kingwood, TX (US); Charles A. Drake, Nowata, OK (US); Ronald D. Knudsen, Bartlesville, OK (US)

(73) Assignee: Phillips Petroleum Company, Bartlesville, OK (US)

( * ) Notice: Subject to any disclaimer, the term of this patent is extended or adjusted under 35 U.S.C. 154(b) by 0 days.

(21) Appl. No.: 09/718,044

(22) Filed: Nov. 21, 2000

(51) Int. Cl.[7] ..... C07C 2/04; C07C 2/08; C07C 2/10

(52) U.S. Cl. ..... 585/326; 585/324; 585/329; 585/502

(58) Field of Search ..... 585/324, 326, 585/329, 502

(56) References Cited

U.S. PATENT DOCUMENTS

| | | | | | |
|---|---|---|---|---|---|
| 3,742,082 | A | | 6/1973 | Brennan | 585/255 |
| 3,763,244 | A | * | 10/1973 | Shubkin | 585/18 |
| RE29,857 | E | * | 12/1978 | Argauer et al. | 208/111.05 |
| 4,267,071 | A | | 5/1981 | Jaffe | 502/220 |
| 4,292,166 | A | | 9/1981 | Gorring et al. | 208/59 |
| 4,372,839 | A | | 2/1983 | Oleck et al. | 208/59 |
| 4,428,865 | A | | 1/1984 | Oleck et al. | 502/77 |
| 4,431,517 | A | | 2/1984 | Nevitt et al. | 208/111 |
| 4,434,047 | A | | 2/1984 | Hensley, Jr. et al. | 208/111 |
| 4,458,024 | A | | 7/1984 | Oleck et al. | 502/66 |
| 4,490,242 | A | | 12/1984 | Oleck et al. | 208/97 |
| 4,524,232 | A | | 6/1985 | Chester et al. | 585/517 |
| 4,568,786 | A | | 2/1986 | Hsia Chen et al. | 585/517 |
| 4,600,503 | A | | 7/1986 | Angevine et al. | 208/251 H |
| 4,650,917 | A | | 3/1987 | Dessau et al. | 585/329 |
| 4,834,949 | A | | 5/1989 | Owen et al. | 422/190 |
| 4,891,457 | A | | 1/1990 | Owen et al. | 585/312 |
| 4,919,896 | A | | 4/1990 | Harandi et al. | 422/142 |
| 4,967,030 | A | | 10/1990 | Landis et al. | 585/241 |
| 4,967,032 | A | * | 10/1990 | Ho et al. | 585/255 |
| 4,983,274 | A | | 1/1991 | Chen et al. | 208/111 |
| 5,000,840 | A | | 3/1991 | Anthes et al. | 208/111 |
| 5,019,357 | A | | 5/1991 | Harandi et al. | 422/192 |
| 5,338,436 | A | | 8/1994 | Harandi | 208/80 |
| 5,396,015 | A | * | 3/1995 | Fricke et al. | 585/671 |
| 5,895,828 | A | | 4/1999 | Yao et al. | 585/418 |
| 5,942,642 | A | | 8/1999 | Beyer et al. | 560/202 |

OTHER PUBLICATIONS

Encyclopedia of Chemical Technology, Kirk–Othmer, Fourth Edition, vol. 16, pp. 888–925.

Encyclopedia of Chemical Technology, Kirk–Othmer, Fourth Edition, vol. 5, pp. 353–373.

* cited by examiner

*Primary Examiner*—Thuan D. Dang

(74) *Attorney, Agent, or Firm*—Conley Rose, P.C.; Rodney B. Carroll; Joe D. Hulett

(57) ABSTRACT

A process is provided for upgrading an oligomerization product through hydrogenation and isomerization with some selective/minor cracking resulting in a synthetic lube base oil with improved pour point and viscosity index. The upgrading process includes contacting the oligomerization product with a hydrogenation catalyst and an isomerization catalyst under conversion conditions, which include the presence of hydrogen and a temperature sufficient to promote hydrogenation and isomerization with some selective/minor cracking. The hydrogenation catalyst contains a porous carrier material and a group VIII metal while the isomerization catalyst contains an aluminosilicate zeolite.

50 Claims, No Drawings

PROCESS FOR UPGRADING AN OLIGOMERIZATION PRODUCT

The present invention relates to a process for upgrading an oligomerization product through use of hydrogenation, selective/minor cracking and isomerization. More particularly, the invention relates to a process for upgrading an oligomerization product through catalytic hydrogenation, selective/minor cracking, and isomerization to yield a synthetic base oil with improved pour point, and increased viscosity index.

BACKGROUND OF THE INVENTION

Preparation of base oil stocks by hydrocracking, dewaxing, and hydrotreating is well known in the art. Generally, mineral oil based hydrocarbon feedstocks with paraffinic content are dewaxed to remove the easily solidified paraffins. Dewaxing may be generally accomplished through two methods. The first method involves hydrocracking in the presence of shape selective catalysts capable of selectively cracking n-paraffins and iso-paraffins. Commonly used shape selective catalysts for hydrocracking are crystalline aluminosilicate zeolites optionally associated with a hydrogenating metal. Typical conditions for catalytic hydrocracking include a temperature between 290° C. and 450° C. and hydrogen partial pressure of 250–1500 psig. Dewaxing may also be performed through solvent dewaxing using refrigeration to crystallize the paraffinic portion of the feed and using a solvent, such as methyl-ethyl-ketone, to sufficiently dilute the oil portion permitting rapid filtration to separate the wax from the oil. Dewaxing is further described by J. Gary and G. Handwerk in Petroleum Refining Technology and Economics, 1984, $2^{nd}$ ed., p. 241–245, which is incorporated by reference herein. Hydrotreating is typically done following catalytic dewaxing to saturate olefinic by-products of the dewaxing process, improve stability, and reduce sulfur content. Hydrotreating processes are described in U.S. Pat. No. 4,267,071 and 4,600,503, which are incorporated by reference herein.

While the purpose of the above mentioned processes is to produce a lubricating base oil with improved stability, pour point, and viscosity index, it is widely believed in the industry that certain levels of oxidative and thermal stability in lubricant oils can only be obtained by using full synthetic formulations as opposed to mineral oil based lubricants. Oxidative stability refers to the ability of the oil to resist oxidation, which generally leads to deterioration of the oil. The belief in the superiority of synthetics has lead to an increasing demand in the industry for high performance, high viscosity index synthetic base oils with high oxidative stability and low pour point. Currently, poly-alpha-olefins (PAOs) are commonly used as synthetic base oils. PAOs are typically produced through the polymerization of 1-alkenes using a Lewis acid, such as $AlCl_3$ or $BF_3$, or Ziegler-catalysts. Their preparation and properties are described by J. Brennan in Ind. Eng. Chem. Prod. Res. Dev. 1980, 19, p. 2–6, which is incorporated herein by reference. PAOs are also described in U.S. Pat. No. 3,742,082, which is incorporated herein by reference. PAOs provide low temperature fluidity (e.g. low pour point), high viscosity index and high oxidative stability; however, PAOs also have a high manufacture price, generally associated with the expense of the 1-alkene feedstock required for PAO production.

This has created a demand for a low cost alternative to PAOs, such as a process for making synthetic base oils from oligomerization products. U.S. Pat. No. 4,650,917, for example, discloses a method for enhancing the viscosity index of a synthetic lubestock by contacting the synthetic lubestock with a solid acidic catalyst, such as an acidic zeolite, under isomerization conditions, then separating out the high viscosity index fraction through sorbing by a shape-selective zeolite, followed by desorbing. Viscosity index is an important characteristic of lubricants because it provides a measure of how much the viscosity of the lubricant changes with temperature. High viscosity index, which indicates a relatively lower rate of viscosity change with temperature, is generally desired. Viscosity index is typically higher in paraffinic stocks, especially paraffinic stocks with minimal branching. This raises a problem, however, because such paraffinic stocks also typically have high pour points, an undesirable quality. Therefore, development of a process for improving the viscosity index and pour point of an oligomerization product for use as a synthetic base oil would be a significant contribution to the art and to the economy.

BRIEF SUMMARY OF THE INVENTION

It is thus an object of this invention to provide an improved process for upgrading an oligomerization product through hydrogenation, selective/minor cracking, and isomerization of the oligomerization product.

It is another object of this invention to provide an improved process for producing a synthetic base oil comprising upgrading an oligomerization product through hydrogenation, selective/minor cracking and isomerization.

It is a further object of this invention to provide a novel catalyst system effective for upgrading an oligomerization product through hydrogenation, selective/minor cracking and isomerization.

It is still another object of this invention to employ this novel catalyst system as a catalyst in the upgrading of an oligomerization product through hydrogenation, selective/minor cracking and isomerization.

The present invention provides a process for upgrading an oligomerization product through hydrogenation, selective/minor cracking and isomerization. The oligomerization product can be an oligomer of an olefin, a co-oligomer of two different olefins or a ter-oligomer of three different olefins. The present invention further provides a process for producing a synthetic base oil by upgrading an oligomerization product. The upgrading process results in a synthetic base oil that exhibits at least one of the following improvements over the oligomerization product:

lower pour point as determined using test method ASTM D97;

higher viscosity index as determined using test method ASTM D567.

Further, the upgrading process results in a product that exhibits physical characteristics making it desirable for use as a synthetic base oil. Such physical characteristics include, but are not limited to, a pour point that is less than 0° C. and a viscosity index that is greater than 100. These values for pour point and viscosity index are representative of commercially acceptable values for a lube base oil.

Also provided in the present invention is a catalyst system for upgrading an oligomerization product. The novel catalyst system comprises a first solid material comprising a porous carrier material and a group VIII metal, and a second solid material comprising an aluminosilicate zeolite. Additionally, a process is provided for the upgrading of an oligomerization product by contacting under conversion conditions the oligomerization product with the novel catalyst system.

Other objects and advantages will become apparent from the detailed description and the appended claims.

DETAILED DESCRIPTION OF THE INVENTION

The oligomerization product to be upgraded according to the present invention comprises oligomeric olefins. Each of the olefins, as they exist in their state prior to oligomerization to form the oligomerization product, typically contain at least 2 and less than 16 carbon atoms per molecule. More typically, each of the olefins, prior to oligomerization, contain at least 2 and less than 10 carbon atoms per molecule; and most typically, each of the olefins, prior to oligomerization, contain at least 2 and less than 5 carbon atoms per molecule. Oligomerization of the olefin units may be carried out by any commonly used method. Because methods of oligomerization are well known to those skilled in the art, a description of such a method of oligomerization is omitted herein for the interest of brevity. Such methods of oligomerization are described in U.S. Pat. Nos. 5,942,642 and 4,526,950, which are incorporated by reference herein.

The oligomerization product can comprise, consist essentially of, or consist of at least one oligomer of an olefin formed by any commonly used method of oligomerization. Alternately, the oligomerization product can comprise, consist essentially of, or consist of a co-oligomer of a first olefin and a second olefin formed by any commonly used method of co-oligomerization. Alternately, the oligomerization product can comprise, consist essentially of, or consist of a ter-oligomer of a first olefin, a second olefin, and a third olefin formed by any commonly used method of ter-oligomerization. Further, the oligomerization product can comprise, consist essentially of, or consist of one or more mixtures of an oligomer, co-oligomer, and ter-oligomer. Examples of suitable olefins for use in oligomerization, co-oligomerization, or ter-oligomerization include but are not limited to: ethene, propene, butene, pentene, hexene, heptene, octene, nonene, decene, undecene, dodecene, tridecene, tetradecene, pentadecene, and any and all straight (n-) and branched-chain (iso-) isomers and isomeric mixtures thereof.

Upgrading of the oligomerization product takes place by catalytic hydrotreating and catalytic isomerization of the oligomerization product through contact with a catalyst system, comprising, consisting of, or consisting essentially of a hydrotreating catalyst and an isomerization catalyst, under conversion conditions. Catalytic isomerization, as used herein, can include, in addition to isomerization, some selective/minor cracking.

The catalyst system of the present invention can comprise, consist essentially of, or consist of a first solid material comprising a porous carrier material and a group VIII metal component and a second solid material comprising or consisting essentially of, or consisting of an aluminosilicate zeolite. The term "metal" used herein also includes a compound of the metal.

The first solid material, to be considered first, is employed as the hydrogenation catalyst. It is preferred that the porous carrier material be a porous, adsorptive, high surface area support having a surface area of about 25 to 500 $m^2/g$. Examples of suitable porous carrier materials include, but are not limited to, aluminas such as for example ($\alpha$-alumina and $\gamma$-alumina; silicas; alumina-silica; aluminum phosphate; aluminum chlorohydrate; clays such as kaolinite, halloysite, vermiculite, chlorite, attapulgite, smectite, montmorillonite, illite, saconite, sepiolite, palygorskite; activated carbon; coke; charcoal; and spinels such as $MgAl_2O_4$, $FeAl_2O_4$, $ZnAl_2O_4$, and $CaAl_2O_4$, and combinations of any two or more thereof. Because these porous carrier materials are well known to one skilled in the art, description of such is omitted herein. The presently preferred porous carrier material is alumina because it is readily available.

An essential ingredient of the first solid material is a metal with hydrogenating ability. In the present invention, the preferred hydrogenating metal is a group VIII metal. The group VIII metal employed in the present invention can be incorporated into the porous carrier material by any suitable method known to one skilled in the art such as ion exchange or impregnation. The group VIII metal can be present in the first solid material in any amount that is catalytically effective to facilitate hydrogenation. Generally, the amount of group VIII metal present in the first solid material is in the range of from about 1 to about 75 weight %, preferably in the range of from about 2 to about 60 weight %, and most preferably in the range of from 5 to 50 based on the total weight of the first solid material, measured on an elemental group VIII metal basis. Any group VIII metal with hydrogenating ability can be used, including iron, cobalt, nickel, ruthenium, rhodium, palladium, osmium, iridium, and platinum. The particularly preferred group VIII metal in the present invention is nickel.

Considering next the second solid material, an aluminosilicate zeolite is used as a catalyst for its ability to promote isomerization and some selective/minor cracking. The class of aluminosilicate zeolite catalyst found particularly useful in the present invention is the shape-selective zeolite of the ZSM type. Useful ZSM type zeolites are those with a silica/alumina ratio of about 20 to about 400; more preferably with a silica/alumina ratio of about 20 to about 200; and most preferably with a silica/alumina ratio of about 30 to about 100. Another desirable characteristic of the ZSM type zeolite is a constraint index of about 1 to about 12. Several specific ZSM type zeolites conform to the necessary values as described above, including, but not limited to ZSM-5, ZSM-11, ZSM-12, ZSM-23, ZSM-35 and ZSM-38. The most preferred zeolite for the present invention is ZSM-5. U.S. Pat. No. 3,702,886 includes a description concerning preparation of ZSM-5 and is incorporated herein by reference. The ZSM-5 zeolite can be used in its alkali metal form, however, for the purposes of the present invention, it is preferred that the ZSM-5 zeolite be in the acidic (hydrogen) form, which can be accomplished by any suitable method known to one skilled in the art. Examples of suitable methods to convert a zeolite to its hydrogen form include acid treatment, where the zeolite is treated with a strong acid (such as HCl), or ion-exchange, where the zeolite is treated with a strong base (such as $NH_3$), thereby forming an ammonium intermediate followed by calcination of the ammonium intermediate to yield the hydrogen form.

The oligomerization product, described above, can be hydrogenated by contacting the oligomerization product with the first solid material (hydrogenation catalyst) comprising, consisting of, or consisting essentially of a porous carrier material and a Group VIII metal component (described above) to thereby produce hydrogenation of at least a portion of the oligomerization product under a condition effective to cause hydrogenation to occur. Reaction conditions for hydrogenation of the oligomerization product can include hydrogen pressure in the range of from about 0 to about 2000 psi; more preferably from about 50 to about 1500 psi; and most preferably from 150 to 1000 psi, and also include a temperature in the range of from about 180° C. to about 230° C.; more preferably from about 200° C. to about 230° C.; and most preferably from 210° C. to 230° C.

The oligomerization product can also be isomerized and selectively/minorly cracked by contacting the oligomerization product with the second solid material (isomerization catalyst) comprising, consisting of, or consisting essentially of an aluminosilicate ZSM-5 zeolite (described above) to thereby produce isomerization and selective/minor cracking of at least a portion of the oligomerization product under a condition effective to cause isomerization and selective/minor cracking to occur. Reaction conditions for isomerization and selective/minor cracking of the oligomerization product can include a temperature in the range of from about 190° C. to about 240° C.; more preferably from about 200° C. to about 235° C.; and most preferably from 210° C. to 230° C.

Contacting the oligomerization product with the first solid material and the second solid material can be carried out in any technically suitable manner, in a batch or semi-continuous or continuous process, and under a condition effective to upgrade the oligomerization product. Generally, the oligomerization product may be introduced into a reactor having a fixed catalyst bed, or a moving catalyst bed, or a fluidized catalyst bed, or combinations of any two or more thereof by any means known to one skilled in the art.

The catalyst system described above can be prepared by placing the first solid material, used for, hydrogenation, into a contacting vessel and placing the second solid material, used for isomerization and selective/minor cracking, into the contacting vessel such that, in the operation of such catalyst system in the upgrading of an oligomerization product, the oligomerization product contacts the first solid material, facilitating hydrogenation, prior to contacting the second solid material, facilitating isomerization and selective/minor cracking.

Alternatively, the catalyst system can be prepared by physically blending the first solid material and the second solid material and placing the resultant mixture into a contacting vessel such that the oligomerization product, when introduced into the contacting vessel, contacts the first solid material and the second solid material simultaneously.

Alternatively, the catalyst system can be prepared by placing the first solid material, used for hydrogenation, into a contacting vessel and placing the second solid material, used for isomerization and selective/minor cracking, into the contacting vessel such that, in the operation of such catalyst system in the upgrading of an oligomerization product, the oligomerization product contacts the second solid material prior to contacting the first solid material.

A preferred aspect of the present invention, whether the first solid material and the second solid material are separate or mixed, is the opportunity for hydrogenation, isomerization and selective/minor cracking to take place in the same reactor at the same temperature. This aspect of the present invention does not limit the scope of the invention by disallowing the use of separate reactors and different temperatures for hydrogenation and isomerization with selective/minor cracking. However, a single reaction temperature may be used for both hydrogenation and isomerization with selective/minor cracking due to the overlap in effective temperature ranges. While a temperature in excess of about 240° C. is generally not recommended, as such an increase in temperature tends to promote deep/severe hydrocracking (which is specifically sought to be avoided here), a somewhat higher temperature can be effective for further reducing the pour point of the oligomerization product.

The following examples are provided to further illustrate this invention and are not to be considered as unduly limiting the scope of this invention.

EXAMPLE I

This example details the nature of catalysts which were subsequently tested as catalysts in the upgrading of an oligomerization product to produce a synthetic lube base stock with improved pour point and increased viscosity index.

Catalyst A

A commercially available $Ni/Al_2O_3$ catalyst manufactured by UCI (Louisville, Ky.) under product designation C38 containing 20 weight % nickel.

Catalyst B

A commercially available ZSM-5 zeolite catalyst in the hydrogen form with a Si/Al ratio of 80, manufactured by UCI (Louisville, Ky.) under product designation T-4480.

Catalyst C

A commercially available ZSM-5 zeolite catalyst in the hydrogen form with a Si/Al ratio of 40, manufactured by UOP (UOP LLC, DesPlaines, Ill.) under product designation MFI-38.

Catalyst D

A commercially available ZSM-5 zeolite catalyst in the hydrogen form with a Si/Al ratio of 40, manufactured by CU Chemie Uetikon AG, (Uetikon, Switzerland) under trademark name Zeocat, product designation PZ-2/50H.

Catalyst E

A commercially available ZSM-5 zeolite catalyst in the hydrogen form with a Si/Al ratio of 80, manufactured by UCI (Louisville, Ky.) under product designation EBUF-1.

EXAMPLE II

This example illustrates the use of the catalysts described in Example I as catalysts in the upgrading of an oligomerization product to provide improved pour point and increased viscosity index. In all runs, the oligomerization product used for upgrading was an ethylene/propylene co-oligomer produced through co-oligomerization via a $Cp_2ZrCl_2$-MAO catalyst obtained from Aldrich Chemical Co. $Cp_2ZrCl_2$ is Bis(cyclopentadiene)zirconium dichloride (Zirconocene) and MAO is methylaluminoxane. The resultant oligomer, prior to upgrading, was quenched with a 10% mixture of HCl in MeOH, washed with water, dried, filtered, and evaporated.

In run 1, a 20 ml sample of catalyst A, described in Example I, was placed into a stainless steel tube reactor (length: about 18 inches; inner diameter: about 0.5 inch). The oligomerization product, as described above, was passed downwardly through the reactor at a flow rate of about 40 ml/hour, at a temperature of about 220° C., and at a pressure of about 500 psig. Additionally, hydrogen gas was added to the reactor at a rate of about 480 ml/minute. The upgraded product exited the reactor tube and was collected and cooled. The product sample was tested for pour point according to test method ASTM D97 and for viscosity index according to test method ASTM D567. Test data results are summarized in Table 1.

In run 2, a 10 ml sample of catalyst A and a 10 ml sample of catalyst B, both described in Example I, were placed into a stainless steel tube reactor (length: about 18 inches; inner diameter: about 0.5 inch) such that catalyst A was the top catalyst (making first contact with the oligomerization product) and catalyst B was the bottom catalyst (making second contact with the oligomerization product). The oligomerization product, as described above, was passed downwardly through the reactor at a flow rate of about 40 ml/hour, at a temperature of about 220° C., and at a pressure of about 500 psig. Additionally, hydrogen gas was added to the reactor at a rate of about 480 ml/minute. The upgraded product exited the reactor tube and was collected and cooled. The product sample was tested for pour point according to test method ASTM D97 and for viscosity index according to test method ASTM D567. Test data results are summarized in Table 1.

In run 3, a 10 ml sample of catalyst A and a 10 ml sample of catalyst C, both described in Example I, were placed into a stainless steel tube reactor (length: about 18 inches; inner diameter: about 0.5 inch) such that catalyst A was the top catalyst (making first contact with the oligomerization product) and catalyst C was the bottom catalyst (making second contact with the oligomerization product). The oligomerization product, as described above, was passed downwardly through the reactor at a flow rate of about 40 ml/hour, at a temperature of about 220° C., and at a pressure of about 500 psig. Additionally, hydrogen gas was added to the reactor at a rate of about 480 ml/minute. The upgraded product exited the reactor tube and was collected and cooled. The product sample was tested for pour point according to test method ASTM D97 and for viscosity index according to test method ASTM D567. Test data results are summarized in Table 1.

In run 4, a 10 ml sample of catalyst A and a 10 ml sample of catalyst D, both described in Example I, were placed into a stainless steel tube reactor (length: about 18 inches; inner diameter: about 0.5 inch) such that catalyst A was the top catalyst (making first contact with the oligomerization product) and catalyst D was the bottom catalyst (making second contact with the oligomerization product). The oligomerization product, as described above, was passed downwardly through the reactor at a flow rate of about 40 ml/hour, at a temperature of about 220° C., and at a pressure of about 500 psig. Additionally, hydrogen gas was added to the reactor at a rate of about 480 ml/minute. The upgraded product exited the reactor tube and was collected and cooled. The product sample was tested for pour point according to test method ASTM D97 and for viscosity index according to test method ASTM D567. Test data results are summarized in Table 1.

In run 5, a 10 ml sample of catalyst A and a 10 ml sample of catalyst E, both described in Example I, were placed into a stainless steel tube reactor (length: about 18 inches; inner diameter: about 0.5 inch) such that catalyst A was the top catalyst (making first contact with the oligomerization product) and catalyst E was the bottom catalyst (making second contact with the oligomerization product). The oligomerization product, as described above, was passed downwardly through the reactor at a flow rate of about 40 ml/hour, at a temperature of about 220° C., and at a pressure of about 500 psig. Additionally, hydrogen gas was added to the reactor at a rate of about 480 ml/minute. The upgraded product exited the reactor tube and was collected and cooled. The product sample was tested for pour point according to test method ASTM D97 and for viscosity index according to test method ASTM D567. Test data results are summarized in Table 1.

TABLE 1

| Run | Catalyst | Temp. (° C.) | Pour point (° C.) | Viscosity Index | wt. % yield Σ 700° F.+ |
|---|---|---|---|---|---|
| 1 | A Only | 220 | −23.0 | 146 | 76.50 |
| 2 | A + B | 220 | −20.2 | 146 | 75.99 |
| 3 | A + C | 220 | −14.4 | 147 | 76.62 |
| 4 | A + D | 220 | −23.5 | 148 | 74.35 |
| 5 | A + E | 220 | −39.0 | 153 | 73.24 |

Wt. % yield Σ 700° F.+ represents a summation of the weight percents of all the compounds present in the product with boiling points equal to and in excess of 700° F..

The test data presented in Table I show that all runs provided an upgraded product with pour point and viscosity index values falling well within the acceptable range (<0° C. for pour point and >100 for viscosity index).

Run 1 demonstrated that the hydrogenation catalyst alone was effective in upgrading the oligomerization product.

Runs 2–5 demonstrated that the particular isomerization catalyst used is important for improving over the results of hydrogenation alone. Runs 2 and 3 showed no improvement over run 1.

Run 4 demonstrated a 2% decrease in pour point and a 1% increase in viscosity index over run 1.

Run 5 demonstrated a 70% decrease in pour point and a 5% increase in viscosity index.

Note that in runs 2–5 there is little appreciable change in wt. % yield Σ700° F.+, which represents the percent of the final product having a boiling point equal to and in excess of 700° F. This indicates minimal cracking of the oligomerization product during the upgrading process.

EXAMPLE III

This example illustrates the effect of reaction temperature on product pour point and product yield. Samples of the same ethylene/propylene co-oligomer used in Example II were also used here.

In run 6, a 10 ml sample of catalyst A and a 10 ml sample of catalyst B, both described in Example I, were placed into a stainless steel tube reactor (length: about 18 inches; inner diameter: about 0.5 inch) such that catalyst A was the top catalyst (making first contact with the oligomerization product) and catalyst B was the bottom catalyst (making second contact with the oligomerization product). The oligomerization product, as described above, was passed downwardly through the reactor at a flow rate of about 40 ml/hour, at a temperature of about 270° C., and at a pressure of about 500 psig. Additionally, hydrogen gas was added to the reactor at a rate of about 480 ml/minute. The upgraded product exited the reactor tube and was collected and cooled. The product sample was tested for pour point according to test method ASTM D97 and for viscosity index according to test method ASTM D567. Test data results are summarized in Table 2.

In run 7, a 10 ml sample of catalyst A and a 10 ml sample of catalyst B, both described in Example I, were placed into a stainless steel tube reactor (length: about 18 inches; inner diameter: about 0.5 inch) such that catalyst A was the top catalyst (making first contact with the oligomerization product) and catalyst B was the bottom catalyst (making second contact with the oligomerization product). The oligomerization product, as described above, was passed downwardly through the reactor at a flow rate of about 40 ml/hour, at a temperature of about 320° C., and at a pressure of about 500 psig. Additionally, hydrogen gas was added to the reactor at a rate of about 480 ml/minute. The upgraded product exited the reactor tube and was collected and cooled.

The product sample was tested for pour point according to test method ASTM D97 and for viscosity index according to test method ASTM D567. Test data results are summarized in Table 2.

In run 8, a 10 ml sample of catalyst A and a 10 ml sample of catalyst B, both described in Example I, were placed into a stainless steel tube reactor (length: about 18 inches; inner diameter: about 0.5 inch) such that catalyst A was the top catalyst (making first contact with the oligomerization product) and catalyst B was the bottom catalyst (making second contact with the oligomerization product). The oligomerization product, as described above, was passed downwardly through the reactor at a flow rate of about 40 ml/hour, at a temperature of about 370° C., and at a pressure of about 500 psig. Additionally, hydrogen gas was added to the reactor at a rate of about 480 ml/minute. The upgraded product exited the reactor tube and was collected and cooled. The product sample was tested for pour point according to test method ASTM D97 and for viscosity index according to test method ASTM D567. Test data results are summarized in Table 2.

TABLE 2

| Run | Catalyst | Temp. (° C.) | Pour point (° C.) | Viscosity Index | wt. % yield Σ 700° F.+ |
|---|---|---|---|---|---|
| 1 | A only | 220 | −23.0 | 146 | 76.50 |
| 2 | A + B | 220 | −20.2 | 146 | 75.99 |
| 6 | A + B | 270 | −23.1 | 148 | 74.60 |
| 7 | A + B | 320 | −29.6 | 144 | 73.70 |
| 8 | A + B | 370 | — | — | 39.38 |

Wt. % yield Σ 700° F.+ represents a summation of the weight percents of all the compounds present in the product with boiling points equal to and in excess of 700° F..

The test data presented in Table 2 shows that increasing the reaction temperature has a positive effect on pour point and a variable effect on viscosity index. The upgrading process, however, is sensitive to increased temperature due to the effects of thermal cracking.

Runs 6 and 7 illustrate the positive effect of increased temperature on pour point and the variable effect on viscosity index. Running the reaction in run 6 at 270° C. caused a 14% decrease in pour point over that achieved in run 2 at 220° C. Running the reaction in run 7 at 320° C. caused a 47% decrease in pour point over that achieved in run 2 at 220° C. While viscosity index showed a 1% increase in run 6 over the viscosity index achieved in run 2, viscosity index dropped in run 7 showing a 1% decrease over the viscosity index achieved in run 2. The wt. % yield Σ700° F.+decreased by 1.8% for run 6 (at 270° C.) and by 3.0% for run 7 (at 320° C.) as compared to run 2 at 220° C.

Run 8 illustrates the negative effects associated with increased reaction temperature. Pour point and viscosity index values were unavailable for run 8 (with a reaction temperature of 370° C.) due to loss of desired product. The wt. % yield Σ700° F.+is almost halved in run 8 as compared to runs 1 and 2. This indicates significant cracking of the product illustrating that while increased temperature can improve pour point, product yield is compromised at elevated temperatures.

Reasonable variations, modifications, and adaptations can be made within the scope of the disclosure and the appended claims without departing from the scope of this invention.

That which is claimed is:

1. A process for upgrading an oligomerization product comprising contacting said oligomerization product with a first solid material comprising a hydrogenation catalyst and a second solid material comprising an isomerization and selective/minor cracking catalyst under conversion conditions, thereby producing an upgraded product having a greater viscosity index than said oligomerization product as determined using test method ASTM D567.

2. A process as recited in claim 1 wherein said oligomerization product comprises oligomeric olefins.

3. A process as recited in claim 1 wherein said oligomerization product comprises at least one oligomer of an olefin, said olefin having 15 or less carbon atoms per molecule.

4. A process as recited in claim 1 wherein said oligomerization product comprises a co-oligomer of a first olefin and a second olefin, said first olefin and said second olefin each having 15 or less carbon atoms per molecule.

5. A process as recited in claim 4 wherein said first olefin is ethylene and said second olefin is propylene.

6. A process as recited in claim 1 wherein said oligomerization product comprises a ter-oligomer of a first olefin, a second olefin, and a third olefin, said first olefin, said second olefin, and said third olefin each having 15 or less carbon atoms per molecule.

7. A process as recited in claim 1 wherein said first solid material comprises a porous carrier material and a group VIII metal component.

8. A process as recited in claim 7 wherein said group VIII metal component is nickel.

9. A process as recited in claim 1 wherein said second solid material comprises a zeolite.

10. A process as recited in claim 9 wherein said zeolite has a molar ratio of silica to alumina of about 20 to about 400.

11. A process as recited in claim 9 wherein said zeolite has a molar ratio of silica to alumina of about 20 to about 200.

12. A process as recited in claim 9 wherein said zeolite has a molar ratio of silica to alumina of about 30 to about 100.

13. A process as recited in claim 9 wherein said zeolite is a ZSM-5 zeolite.

14. A process as recited in claim 9 wherein said zeolite is in the hydrogen form.

15. A process as recited in claim 1 wherein said oligomerization product contacts said first solid material prior to contacting said second solid material.

16. A process as recited in claim 1 wherein said oligomerization product contacts said second solid material prior to contacting said first solid material.

17. A process as recited in claim 1 wherein said oligomerization product contacts said first solid material and said second solid material simultaneously.

18. A process as recited in claim 1 wherein said conversion conditions for contacting said oligomerization product with said first solid material comprise the presence of hydrogen and a temperature between about 180° C. and about 230° C.

19. A process as recited in claim 1 wherein said conversion conditions for contacting said oligomerization product with said second solid material comprise a temperature between about 190° C. and 240° C.

20. A process as recited in claim 1 wherein said conversion conditions for contacting said oligomerization product with said first solid material and said second solid material comprise the presence of hydrogen and a temperature in the range of from about 190° C. to about 230° C.

21. A process for producing a synthetic base oil comprising contacting an oligomerization product under conversion conditions with:

(a) a first solid material comprising a porous carrier material and a group VIII metal; and (b) a second solid material comprising a zeolite, wherein the oligomerization product is isomerized, selective/ minor cracked, and hydrogenated to produce the synthesis base oil, wherein said synthetic base oil exhibits a greater viscosity index than said oligomerization product as determined using test method ASTM D567.

22. A process as recited in claim 2 wherein said oligomerization product comprises oligomeric olefins.

23. A process as recited in claim 21 wherein said oligomerization product comprises at least one oligomer of an olefin, said olefin having 15 or less carbon atoms per molecule.

24. A process as recited in claim 21 wherein said oligomerization product comprises a co-oligomer of a first olefin and a second olefin, said first olefin and said second olefin each having 15 or less carbon atoms per molecule.

25. A process as recited in claim 24 wherein said first olefin is ethylene and said second olefin is propylene.

26. A process as recited in claim 21 wherein said oligomerization product comprises a ter-oligomer of a first olefin, a second olefin, and a third olefin, said first olefin, said second olefin, and said third olefin each having 15 or less carbon atoms per molecule.

27. A process as recited in claim 21 wherein said group VIII metal component is nickel.

28. A process as recited in claim 21 wherein said zeolite has a molar ratio of silica to alumina of about 20 to about 400.

29. A process as recited in claim 21 wherein said zeolite has a molar ratio of silica to alumina of about 20 to about 200.

30. A process as recited in claim 21 wherein said zeolite has a molar ratio of silica to alumina of about 30 to about 100.

31. A process as recited in claim 21 wherein said zeolite is a ZSM-5 zeolite.

32. A process as recited in claim 21 wherein said zeolite is in the hydrogen form.

33. A process as recited in claim 21 wherein said oligomerization product contacts said first solid material prior to contacting said second solid material.

34. A process as recited in claim 21 wherein said oligomerization product contacts said second solid material prior to contacting said first solid material.

35. A process as recited in claim 21 wherein said oligomerization product contacts said first solid material and said second solid material simultaneously.

36. A process as recited in claim 21 wherein said conversion conditions for contacting said oligomerization product with said first solid material comprise the presence of hydrogen and temperatures between about 180° C. and about 230° C.

37. A process as recited in claim 21 wherein said conversion conditions for contacting said oligomerization product with said second solid material comprise temperatures between about 190° C. and 240° C.

38. A process as recited in claim 21 wherein said conversion conditions for contacting said oligomerization product with said first solid material and said second solid material comprise the presence of hydrogen and a temperature of about 190° C. to about 230° C.

39. A process as recited in claim 21 wherein said synthetic base oil exhibits a lower pour point than said oligomerization product as determined using test method ASTM D97.

40. A process as recited in claim 21 wherein said synthetic base oil exhibits a pour point that is less than 0° C. as determined using test method ASTM D97.

41. A process as recited in claim 21 wherein said synthetic base oil exhibits a pour point that is less than −20° C. as determined using test method ASTM D97.

42. A process as recited in claim 21 wherein said synthetic base oil exhibits a viscosity index that is greater than 100 as determined using test method ASTM D567.

43. A process as recited in claim 21 wherein said synthetic base oil exhibits a viscosity index that is greater than 140 as determined using test method ASTM D567.

44. A process for upgrading an oligomerization product which comprises contacting said oligomerization product in the presence of hydrogen at a temperature in the range of from about 1 80° C. to about 230° C. with a catalyst system disposed in a reactor vessel, said catalyst system comprising:

a first solid material comprising a hydrogenation catalyst; and a second solid material comprising an isomerization and selective/minor cracking catalyst.

45. A process as recited in claim 44 wherein said oligomerization product comprises oligomeric olefins.

46. A process as recited in claim 44 wherein said oligomerization product comprises at least one oligomer of an olefin, said olefin having 15 or less carbon atoms per molecule.

47. A process as recited in claim 44 wherein said oligomerization product comprises a co-oligomer of a first olefin and a second olefin, said first olefin and said second olefin each having 15 or less carbon atoms per molecule.

48. A process as recited in claim 44 wherein said first olefin is ethylene and said second olefin is propylene.

49. A process as recited in claim 44 wherein said oligomerization product comprises a ter-oligomer of a first olefin, a second olefin, and a third olefin, said first olefin, said second olefin, and said third olefin each having 15 or less carbon atoms per molecule.

50. The process as recited in claim 1 wherein said upgraded product has a lower pour point than said oligomerization product as determined using test method ASTM D97.

* * * * *